US005433034A

United States Patent [19]

Bernstein

[11] Patent Number: 5,433,034

[45] Date of Patent: Jul. 18, 1995

[54] IRONING BOARD WITH FLUID FLOW THERETHROUGH

[75] Inventor: David S. Bernstein, Altrincham, United Kingdom

[73] Assignee: Coach Enterprises Limited, Manchester, United Kingdom

[21] Appl. No.: 334,451

[22] Filed: Nov. 4, 1994

Related U.S. Application Data

[63] Continuation of Ser. No. 861,864, filed as PCT/GB90/01711, Nov. 7, 1990, abandoned.

[30] Foreign Application Priority Data

Dec. 16, 1989 [GB] United Kingdom ..... 8928447
Oct. 30, 1990 [GB] United Kingdom ..... 9023545

[51] Int. Cl.[6] ..... D06F 81/08

[52] U.S. Cl. ..... 38/103; 38/106; 38/66

[58] Field of Search ..... 38/1 C, 16, 15, 14, 38/66, 99, 103, 104, 107, 137, DIG. 1; 108/33, 35, 38, 39, 40, 42, 48

[56] References Cited

U.S. PATENT DOCUMENTS

| | | | |
|---|---|---|---|
| 1,655,516 | 1/1928 | Simpson | 108/38 X |
| 1,729,353 | 9/1929 | Mitkoff | 38/103 |
| 2,399,576 | 4/1946 | Shoop et al. | 38/16 X |
| 3,430,370 | 3/1969 | Topliffe | 38/104 |
| 3,742,868 | 7/1973 | Garceau et al. | 108/39 |
| 4,274,214 | 6/1981 | Haüser | 38/1 C |
| 4,442,616 | 4/1984 | Hauser et al. | 38/103 X |
| 4,536,978 | 8/1985 | Cerutti | 38/103 |
| 5,315,773 | 5/1994 | Iwani et al. | 38/107 X |

FOREIGN PATENT DOCUMENTS

| | | | |
|---|---|---|---|
| 1133379 | 10/1982 | Canada | 38/103 |
| 2598303 | 11/1987 | France . | |
| 2414001 | 10/1975 | Germany . | |
| 2552778 | 12/1976 | Germany . | |
| 3023806 | 1/1981 | Germany . | |
| 3633087 | 3/1988 | Germany | 38/103 |
| 0115100 | 7/1984 | Japan | 38/103 |
| 1519356 | 7/1978 | United Kingdom . | |

*Primary Examiner*—Clifford D. Crowder
*Assistant Examiner*—Ismael Izaguirre
*Attorney, Agent, or Firm*—Thomas R. Vigil; James P. Hanrath

[57] ABSTRACT

An ironing table (40) has an ironing board (41) which is perforated by a number of bores. A vacuum pump or suction fan is mounted in a housing (47) adjacent the board (41) and can communicate with a chamber (46) disposed below the board (41). The pump or fan operate to lower the pressure in the chamber (46) thereby forming a pressure gradient between top and bottom surfaces of the ironing board (41) whereby steam will be positively drawn from an iron through the garment being ironed, into the bores and into the chamber (46). The steam will condense on the relatively cooler walls of the chamber (46) and will drain to one end due to the inclined base of the chamber (46) and can be drained away after ironing via drainage tap.

22 Claims, 5 Drawing Sheets

41
40
46
-64-
63
61
60
67
66
62

IRONING BOARD WITH FLUID FLOW THERETHROUGH

This is a continuation of application Ser. No. 07/861,864, filed as PCT/GB90/01711, Nov. 7, 1990, abandoned, which is the national stage of international application PCT/GB90/01711, now abandoned.

This invention relates to ironing apparatus and more particularly to an ironing board adapted for domestic or home use.

BACKGROUND ART

Conventionally when it is necessary to iron a garment having a large number of creases or creases of a particularly stubborn nature, it is usual to force steam into the fabric by emission of the same from the iron. However, generally the steam will not pass fully into the fabric and furthermore since conventional ironing boards are solid, the steam is not easily dispersed and thus becomes trapped between the iron and the fabric. This necessitates the application of undue pressure to the iron to remove the creases and this can cause undesirable wear on the fabric of the garment. A further problem arises in so far as the ironing process may have to be repeated a number of times and thus the ironing time can be lengthened by an unacceptable degree.

It is an object of the present invention to provide ironing apparatus which overcomes or at least minimises the abovementioned problems.

DISCLOSURE OF THE INVENTION

According to the present invention therefore there is provided ironing apparatus comprising an ironing surface adapted to permit fluid flow therethrough, and suction means operable to draw fluid through said surface.

With this arrangement it is possible to provide apparatus whereby ironing of garments can be performed in a quick and efficient manner without unnecessary wear on the fabric of the garment.

Preferably a receiving chamber is provided below said surface to receive said fluid and said suction means may be operable to create a lower pressure in said chamber relative to the pressure above said surface thereby to draw said fluid therethrough.

The ironing surface may be partially or wholly adapted to permit passage of fluid therethrough and preferably at least a major part thereof is so adapted.

The adaptation of the surface may comprise the provision of multiple bores therein, which bores may extend therethrough into communication with said chamber. Thus the ironing surface may comprise a top surface of an ironing board, and the board may comprise an elongate member which is curved at one end thereof.

A layer of porous material may be provided between the surface and the chamber, which material acts to provide a barrier between the low pressure in the chamber and the high pressure (relative thereto) above the surface.

The chamber may have an inclined base thereto to allow fluid to flow to one end thereof and a drainage tap may be provided at said one end to permit emptying of said chamber. The ironing board may form the top of said chamber.

The suction means may comprise a vacuum pump having an outlet connected to said chamber or said suction means may comprise a fan. The means may be mounted adjacent said one end of the chamber and may be mounted in a housing. In this case the housing may have a top surface which extends parallel to and forms an extension of said ironing surface on which an iron can be placed when not in use.

A user operable control switch for said suction means may be mounted externally of the housing.

The apparatus may be adapted for mounting relative to a ground surface by way of support legs. The support legs may be capable of folding away in conventional manner by being pivotally linked.

A cover may be provided to cover the ironing surface, which cover may be formed from porous material.

BRIEF DESCRIPTION OF THE DRAWINGS

The invention will now be described further by way of example only and with reference to the accompanying drawings of which.

BEST MODE FOR CARRYING OUT THE INVENTION

Figure 1:
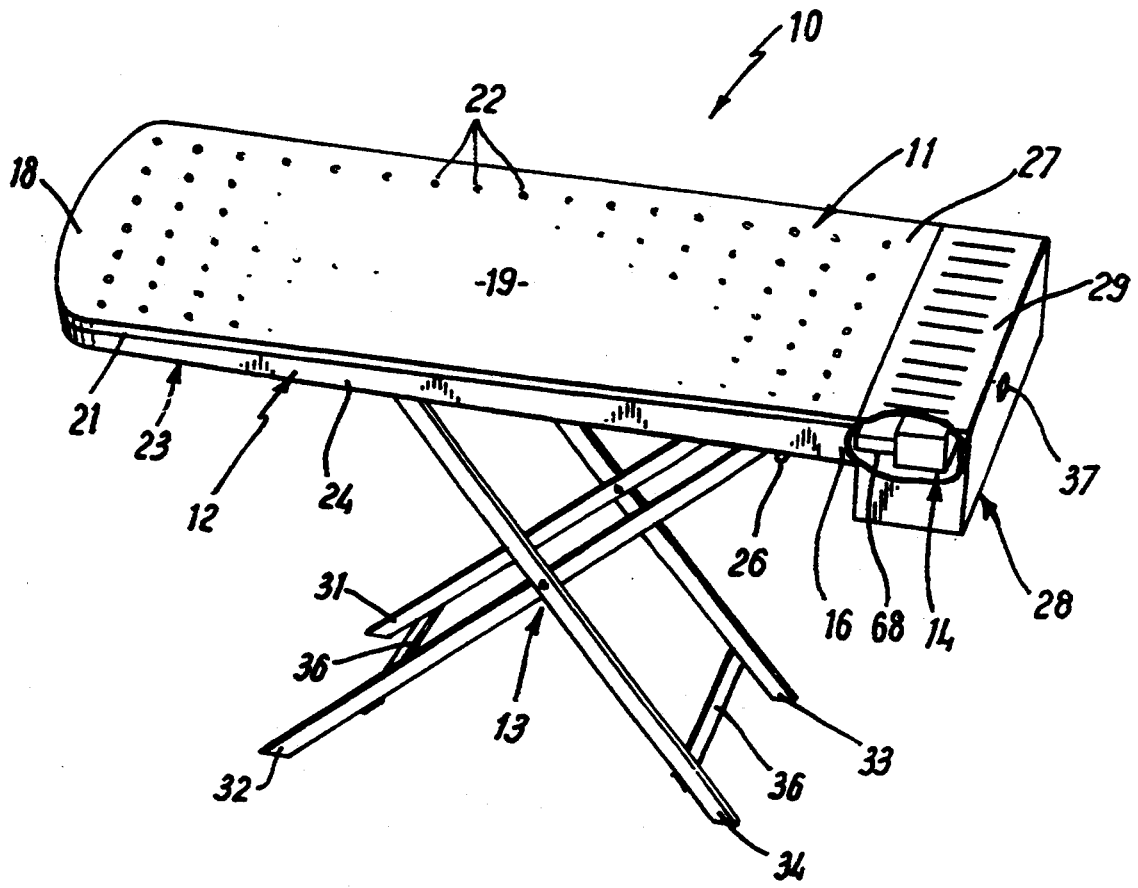
FIG. 1 shows one form of ironing apparatus according to the invention.

Referring now to FIG. 1, there is shown an ironing table 10 which is particularly suited to domestic use.

The table 10 comprises an upper ironing board 11, a receiving chamber 12 below the board 11, support legs 13 to mount the table 10 relative to a ground surface (not shown) and a vacuum pump 14 disposed at one end 16 of the chamber 12.

The ironing board 11 comprises an elongate planar structure which is curved at one end 18 thereof. The board 11 can be fabricated from metallic, wood or plastics material or any other material of sufficient rigidity. The top surface 19 of the board 11 is covered with a porous cover (not shown) and defines an ironing surface, the lower surface (not shown) of the board 11 being covered with a similar layer 21 of a porous material for a purpose to be described hereinafter. The board 11 has multiple bores 22 disposed substantially over the entire area of the board 11, the bores 22 extending through the board 11 from the top surface 19 into communication with the chamber 12.

The chamber 12 is disposed below the board 11 and is defined by a planar base 23 and a peripheral side wall 24, the top of the chamber 12 being provided by the board 11. The base 23 of the chamber 12 is inclined downwardly relative to the board 11 in a direction away from the curved end 18 thereof for a purpose to be described hereinafter. A drainage tap 26 is provided at the end 16 of the chamber remote from the curved end 18 of the board 11 which allows the contents of the chamber 12 to be drained away.

A vacuum pump 14 is mounted at the opposite end 27 of the board 11 to the curved end 18 and the pump outlet (not shown) is connected to the chamber 12 in any suitable manner. In the embodiment shown the pump is mounted in a housing 28 alongside the remote end 16 of the chamber 12, the top 29 of the housing 28 lying adjacent the ironing surface 19 and forming a convenient iron rest.

The support legs 13 are formed by two pairs of elongate members 31, 32 and 33, 34, respective ones 31, 32 and 33, 34 of each pair extending generally parallel to each other. Opposite members 31, 33 and 32, 34 of each respective pair are pivotally connected to each other substantially at the centre thereof and lower ends of the members of each pair 31, 32 and 33, 34 are linked together with a cross bar 36. The upper ends of one pair 31, 32 of members are pivotally connected to the underside of the base 23 of the chamber 12 and the upper ends of the second pair 33, 34 are located relative to the underside of the base 23 in such a manner as to permit movement towards and away from the upper ends of the one pair 31, 32 in conventional manner.

In use the table 10 is set up with the ironing board 11, and thus the ironing surface 19, substantially horizontal by positioning of the legs 31, 32 and 33, 34 in conventional manner. A steam iron (not shown) is then set up for operation and the iron rest 29 can be used to place the iron on when not in use.

The vacuum pump 14 is then actuated by operation of a user control switch 37 mounted on a side of the housing 28. The vacuum pump 14 reduces the pressure within the chamber 12 and thus a pressure gradient is created across the ironing board 11.

Thus when ironing a garment, with the fabric held over the ironing surface 19 of the board 11, steam from the iron is positively drawn through the fabric and thus creases are removed with the minimum of effort. Once the steam has passed through the fabric, it enters the chamber 12 via the bores 22 in the board 11. Since the chamber 12 is generally cooler than the iron, when the steam hits the chamber walls 23, 24 it will condense and will flow towards end 16 of the chamber 12 due to the inclined base 23 and can thus be drained away via drainage tap 26 after completion of the ironing.

With this arrangement it will be appreciated that improved ironing results in so far as creases are removed more efficiently due to the steam passing fully through the fabric and furthermore the "set" (i.e. results of the ironing) of the fabric are retained for a longer period. As a consequence of the above efficiency, it is not necessary to apply undue pressure on the fabric and thus the lifetime of the garment is increased in so far as there is less wear on the fabric due to ironing. A further advantage lies in the fact that ironing time can be reduced by a significant amount.

Figure 2:
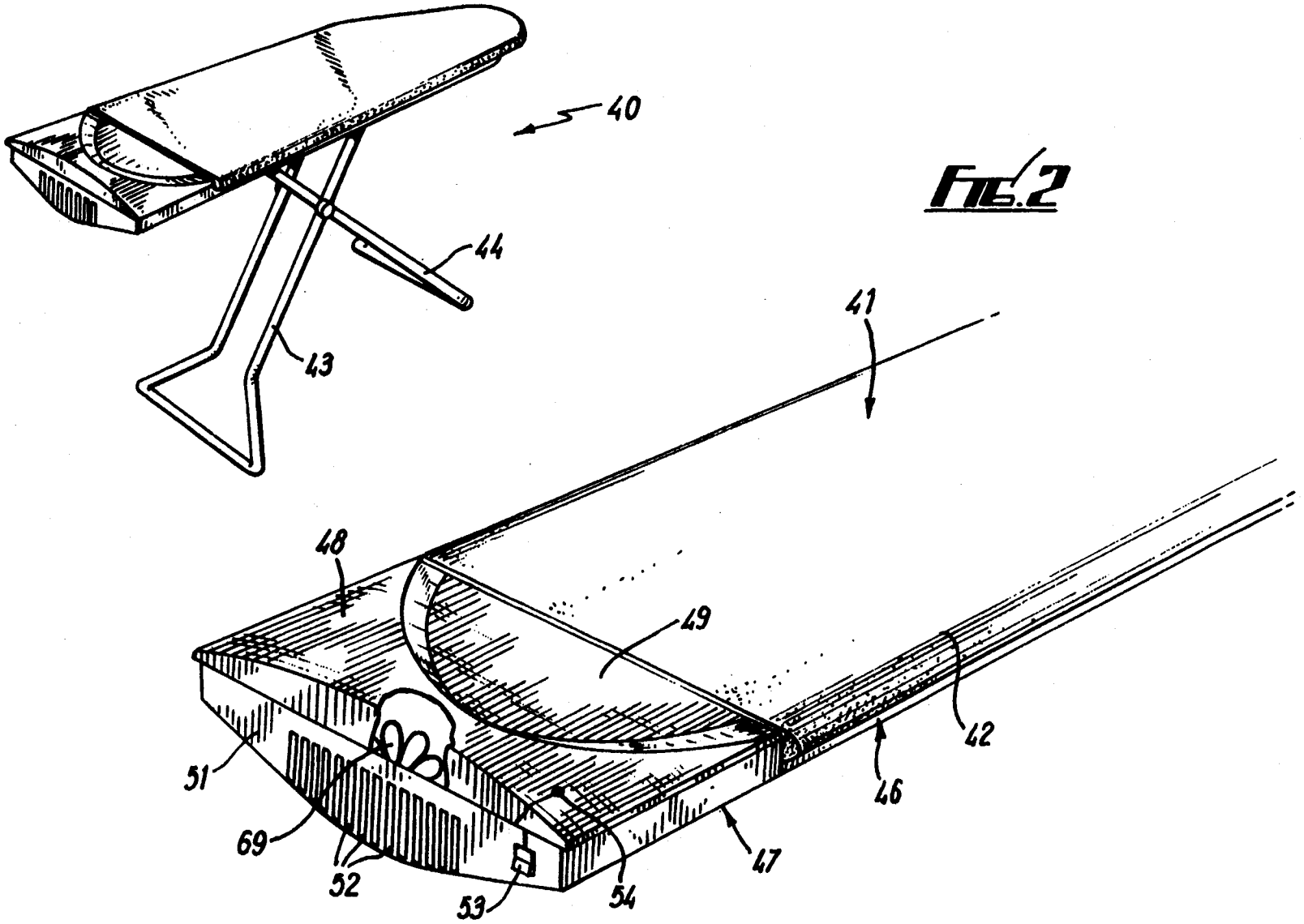
FIG. 2 shows a perspective view of a second embodiment of ironing apparatus according to the invention.
Figure 3:
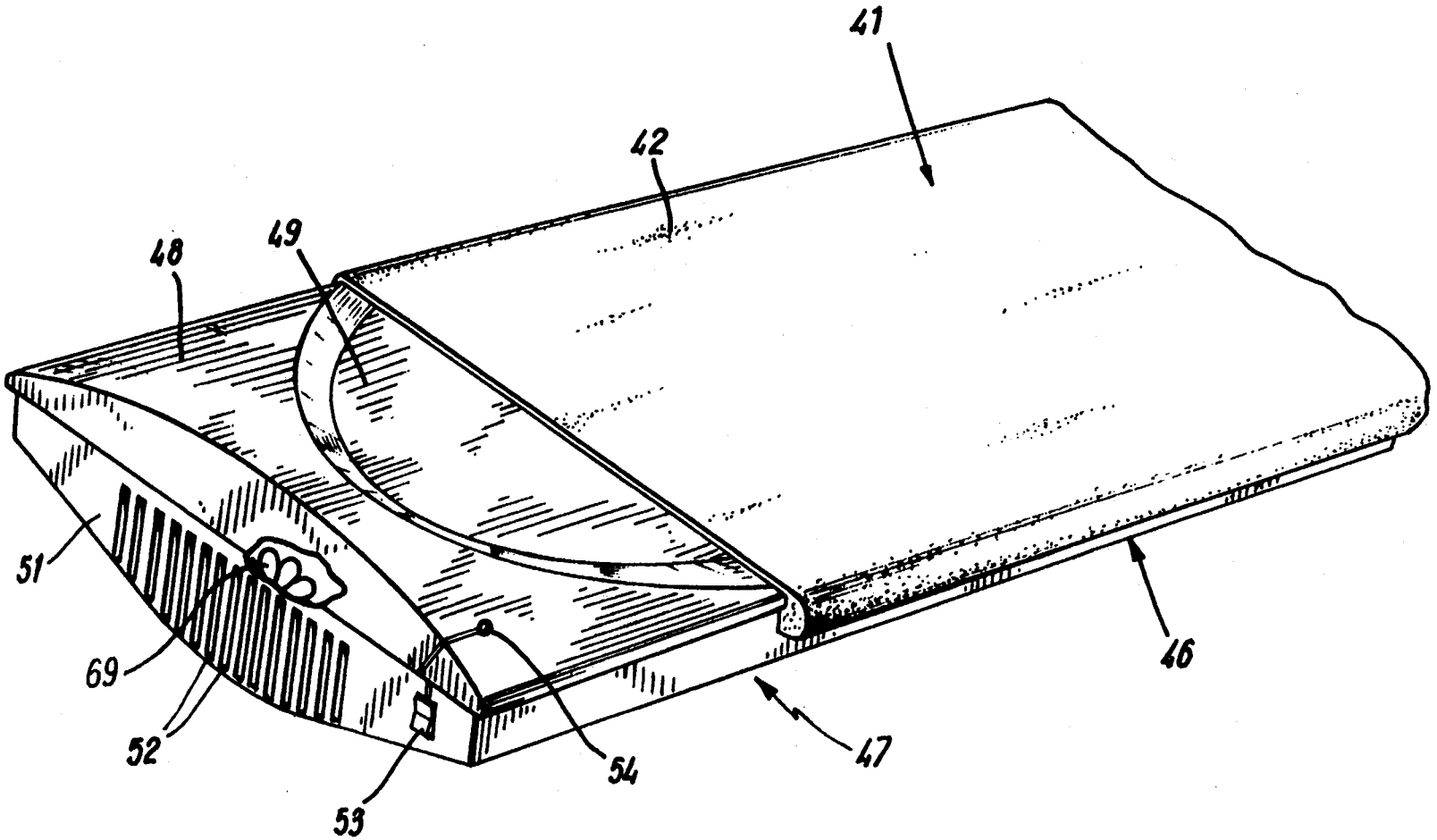
FIG. 3 shows part of the ironing apparatus of FIG. 2 in more detail.

FIGS. 2 and 3 show a second embodiment of ironing table. The ironing table 40 comprises a perforated ironing board 41 covered on a top surface with a fabric cover 42, the ironing board 41 having attached thereto a pair of support legs 43, 44 in a similar manner to that described above in relation to the first embodiment, whereby the board 11 can be mounted relative to a ground surface (not shown).

The ironing board 41 is of a generally similar nature to that described above in relation to the first embodiment and has multiple throughbores (not shown) therein. Once again a chamber 46 is provided which extends the full length of the board 41 and is disposed beneath the same.

However in this embodiment a suction fan (not shown) is mounted at one end of the board 41 and is contained within a housing 47 secured to the end of the ironing board 41. The fan is capable of communicating with the interior of the chamber 46 in any suitable manner and for a purpose to be described hereinafter.

The housing 41 has a top surface 48 which lies adjacent the surface of the ironing board and has a recessed part 49 of arcuate form which forms a convenient iron rest when the iron is not in use.

An end wall 51 of the housing has a plurality of slits 52 therein, which slits 52 act to allow the free flow of air into and out of the housing 47. Thus it is possible both to allow cooling of the fan during operation thereof due to the influx of relatively cool air from outside the housing 47 and also to allow the efflux of air therefrom for a purpose to be described hereinafter.

A user operable control switch 53 is provided on the end wall 51 for actuating the operation of the fan during ironing and, when such switch is in the ON position, this fact is indicated by way of an indicator 54 in the form of a light emitting diode (LED) mounted on the top surface 48 of the housing 47.

In use therefore, the fan is actuated by way of the control switch 53 and the fan causes a reduction in the pressure within the chamber 46 in an analogous manner to that described above in relation to the vacuum pump of the first embodiment.

Thus when ironing a garment held over the ironing board 41, steam is positively drawn through the fabric and passes through the throughbores and into the chamber 46. When the steam hits the chamber walls it will condense due to these walls being cooler than the iron. The water is retained in the chamber 46 and can be drained away in a like manner to that described in relation to the first embodiment.

Figure 4:
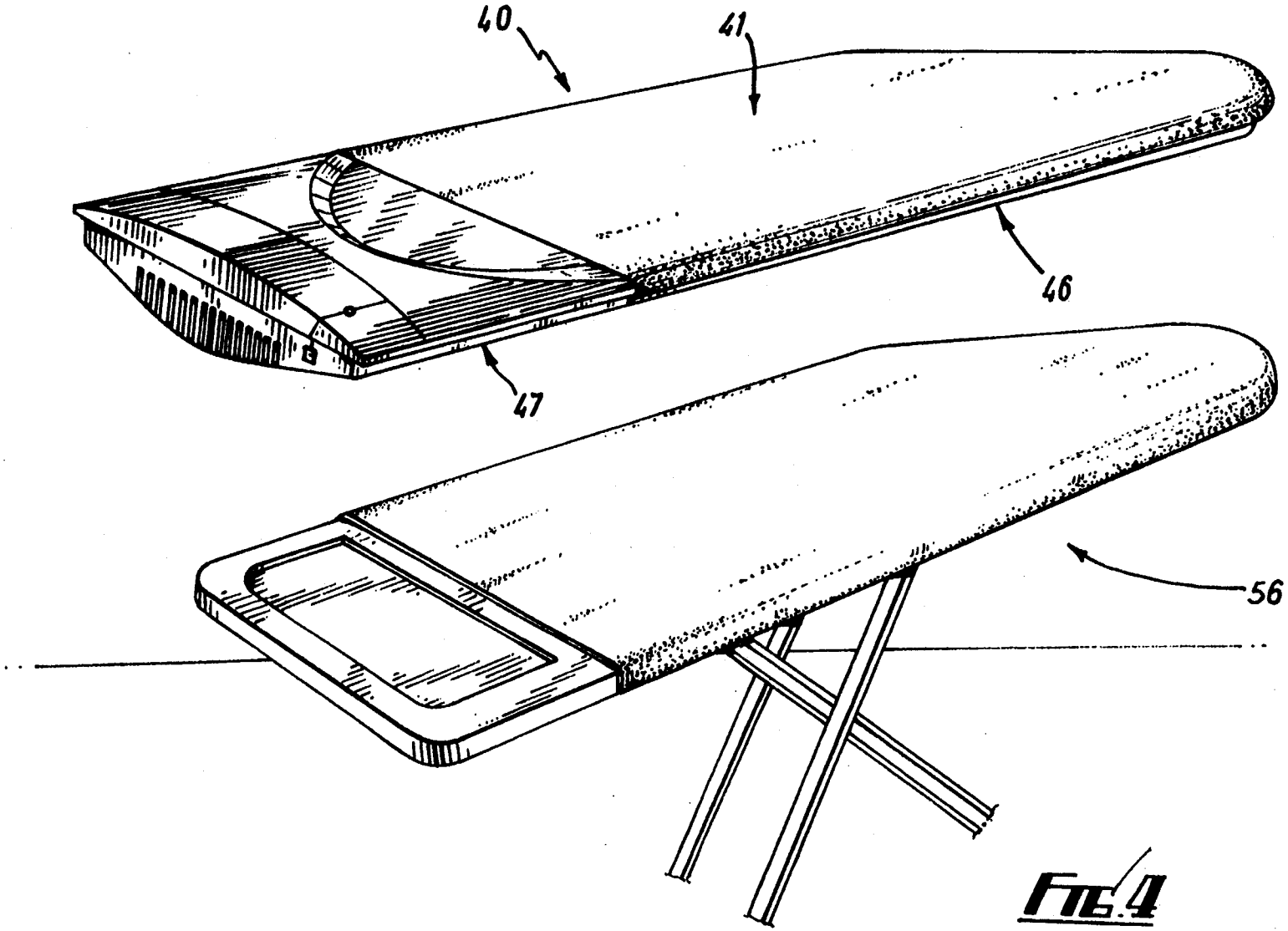
FIG. 4 shows a third embodiment of ironing apparatus according to the invention.

FIG. 4 shows a third embodiment which generally comprises the ironing table 40 of the second embodiment but without the support legs 43, 44. Thus the ironing table 40 comprises an ironing board 41, a chamber 46 mounted below the board 41 and a housing 47 mounted at one end of the board 41, the housing 47 containing the fan. This embodiment of ironing table 40 is adapted in an appropriate manner, for example by use of bolts or screws or any other suitable fastening (not shown) to be removably attached to an existing ironing board 56 as shown in the Figure. This enables an existing table to be converted to a table according to the invention in a particularly simple and convenient manner.

Figure 5:
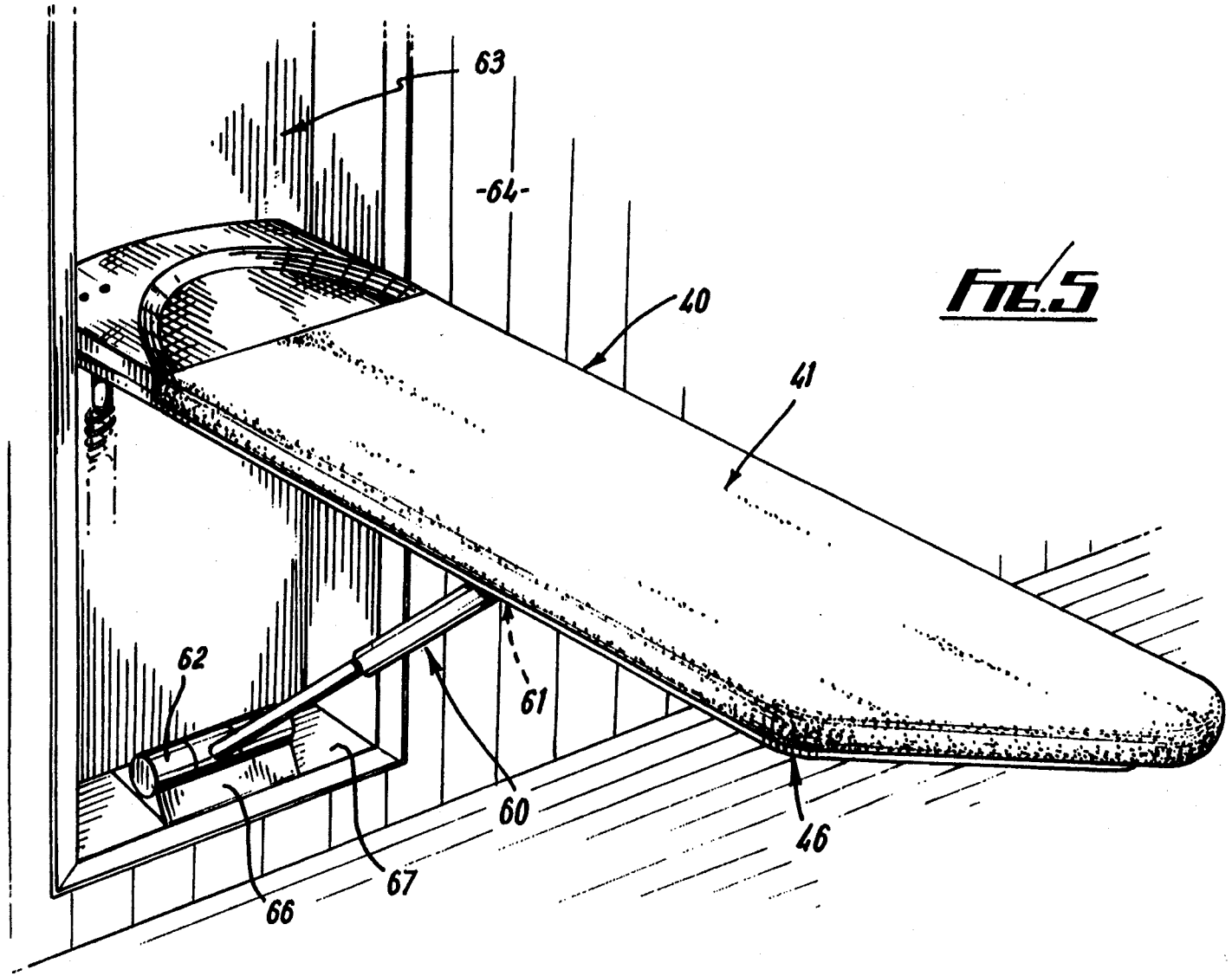
FIG. 5 shows a fourth embodiment of ironing apparatus according to the invention.

FIG. 5 shows a fourth embodiment which generally comprises the ironing table 40 of the second embodiment but adapted so as to be wall mounted and stored.

In this respect the ironing board 41 has a support member 60, one end 61 of which is pivotally connected to the underside of the chamber 46. The other end of the support member is enlarged to form a transversely extending generally cylindrical stop 62.

In use, the ironing board 41 is mounted in a recess 63 in a wall 64 or similar structure. A wedge-shaped retaining structure 66 is mounted on a bottom surface 67 of the recess 63 for a purpose to be described hereinafter.

The stop 62 of the support member 60 is located behind the retaining member 66 and is retained in such position thereby. Thus when in use the ironing board 41 is in the position shown in the Figure. When a user has completed the ironing operation then the board 41 can be pivoted upwardly about the connection with the support member 60 such that the housing end the board 41 moves upwardly and the board 41 can then be pushed into the recess 63 for storage. If necessary a retention device (not shown) can be used to retain the board in the upright stored position. When it is desired to use the board 41 once again, the reverse of the above is performed in order to return the board 41 to the in-use position.

It will be appreciated that the board 41 of the fourth embodiment can be fitted simply and conventiently into new homes when they are built.

It is of course to be understood that the invention is not intended to be restricted to the details of the above embodiment which are described by way of example only.

Thus for example it may be possible to arrange for a plug-in socket to be provided on the housing 47 whereby the iron can be plugged into the ironing table 40 rather than being plugged into a remote plug socket.

I claim:

1. An ironing board (11, 41) comprising an ironing surface (19) adapted to permit fluid flow therethrough, a receiving chamber (12, 46) below said surface to receive fluids and suction means (14) operable to reduce the pressure in said chamber (12, 46) relative to that above said surface, said ironing surface (19) defining a top of the board and a base of said receiving chamber (12, 46) defining a bottom of said board, said ironing surface (19) comprising two layers, one of said layers comprising a perforated body which allows fluid to flow therethrough and a second layer (21) comprising a porous layer which acts to restrict flow of fluid through the layers, said layers of said ironing surface (19) acting to provide a barrier between the low pressure in the chamber (12, 46) and the high pressure, relative thereto, above the ironing surface (19) whereby when an iron passes over the ironing surface, fluid emitted therefrom is drawn through the ironing surface (19) into the receiving chamber (12, 46), said ironing board further comprising a surface (48) which lies adjacent to and generally parallel to the ironing surface to support an iron away from the ironing surface (19) when ironing is not being undertaken, characterized in that said suction means (14) is contained wholly within a housing (47) which is in communication with, but separate from, the receiving chamber (12, 46), said housing (47) not extending beyond said top and bottom of said board (11, 41), said further surface (48) being formed by a top surface of said housing (47).

2. An ironing board according to claim 1, characterized in that said ironing surface (19) is formed by a top surface of said ironing board (11).

3. An ironing board according to claim 2, characterized in that said board (11) has a curved end (18) thereto.

4. An ironing board according to claim 2, characterized in that said layers (11) form a top to said chamber (12).

5. An ironing board according to claim 1, characterized in that said second layer of porous material (21) is provided between the surface (19) and the chamber (12).

6. An ironing board according to claim 1, characterised in that said chamber (12) has an inclined base (23) thereto to allow fluid to flow to one end thereof.

7. An ironing board according to claim 6, characterised in that a drainage tap (26) is provided at said one end to permit emptying of said chamber (12).

8. An ironing board according to claim 1, characterised in that said suction means comprises a vacuum pump (14) having an outlet connected to said chamber (12).

9. An ironing board according to claim 1 characterised in that said suction means comprises a fan.

10. An ironing board according to claim 1, characterized in that said suction means is mounted in a housing (28) adjacent said chamber (12).

11. An ironing apparatus according to claim 10, characterized in that said housing (28) has a top surface (29) which extends parallel to and forms an extension of said ironing surface (19) on which an iron is placed when not in use.

12. An ironing board according to claim 10, characterised in that a user operable control switch (37) for said suction means is mounted externally of said housing (28).

13. An ironing board according to claim 1 having support legs (13) for mounting the ironing board relative to a ground surface.

14. An ironing board according to claim 13, characterised in that said support legs (13) are capable of being folded away by being pivotally linked together.

15. An ironing board according claim 1, characterised in that a cover (42) is provided to cover the ironing surface.

16. An ironing board according to claim 15, characterised in that said cover is formed from a porous material.

17. An ironing board according to claim 1, further including means for mounting the ironing board in or to a wall or surface.

18. An ironing board according to claim 1, further including means for connecting the ironing board to an ironing table.

19. An ironing board according to claim 1, characterized in that said ironing surface (19) is adapted over a major part thereof to permit passage of fluid therethrough.

20. An ironing board according to claim 1, characterized in that said adaptation of the surface comprises the provision of multiple bores (22) therein.

21. An ironing board according to claim 20, characterized in that said bores (22) extend through said surface into communication with said chamber (12).

22. An ironing board according to claim 1, further comprising an iron rest (29) at one end (27) of said board (10), said board (10) having a longitudinal axis and a width transverse thereto and said receiving chamber having a depth thereto characterized in that said depth is a minor proportion of the width of said board.

* * * * *

UNITED STATES PATENT AND TRADEMARK OFFICE

CERTIFICATE OF CORRECTION

PATENT NO. : 5,433,034
DATED : July 18, 1995
INVENTOR(S) : David S. Bernstein

It is certified that error appears in the above-indentified patent and that said Letters Patent is hereby corrected as shown below:

Column 4, line 65, "end the" should be --end of the--.

Column 6, line 31, "according claim" should be -- according to claim--.

Signed and Sealed this

Seventh Day of November, 1995

*Attest:*

*Attesting Officer*

BRUCE LEHMAN

*Commissioner of Patents and Trademarks*